United States Patent [19]

Schneiter

[11] 3,949,547

[45] Apr. 13, 1976

[54] ESCAPEMENT OR COUNTING MECHANISM FOR A TIMEPIECE HAVING A BALANCE-WHEEL

[75] Inventor: Ali Schneiter, Neuchatel, Switzerland

[73] Assignee: Ebauches S.A., Neuchatel, Switzerland

[22] Filed: Oct. 21, 1974

[21] Appl. No.: 516,721

[30] Foreign Application Priority Data

Oct. 31, 1973 Switzerland..... 15334/73

[52] U.S. Cl...... 58/116 R; 58/116 M; 74/1.5

[51] Int. Cl.[2]..... G04B 15/00

[58] Field of Search..... 74/1.5; 58/116 R, 116 M, 58/117, 107, 28 R, 28 A, 28 B, 28 D, 59

[56] References Cited

UNITED STATES PATENTS

| | | | |
|---|---|---|---|
| 2,977,750 | 4/1961 | Biemiller et al. | 58/28 D |
| 3,016,685 | 1/1962 | Reese | 58/28 D |
| 3,681,915 | 8/1972 | Kanazawa et al. | 58/28 D |

*Primary Examiner*—Ulysses Weldon

*Attorney, Agent, or Firm*—Silverman & Cass, Ltd.

[57] ABSTRACT

A timepiece mechanism including an escapement or counting wheel. A balance wheel with two abutting members cooperates with the teeth of the escapement or counting wheel. The action of one abutting member causes the escapement or counting wheel to leave a rest position against the influence of a magnet; the action of the second abutting member furnishes driving energy to the balance wheel.

3 Claims, 4 Drawing Figures

ESCAPEMENT OR COUNTING MECHANISM FOR A TIMEPIECE HAVING A BALANCE-WHEEL

BACKGROUND OF THE INVENTION

The present invention relates to an escapement or counting mechanism for a timepiece having a balance-wheel.

SUMMARY OF THE INVENTION

The mechanism is characterized by the fact that an escapement or counting wheel is submitted to the action of means ensuring the stability of the several rest positions of the wheel; the balance-wheel of the timepiece carries two abutting members with which the teeth of the said wheel cooperate successively; the action of one of said abutting members on one tooth of the wheel causes the wheel to leave its rest position, against the action of said stabilizing means, while the action of one tooth of the wheel on the second abutting member, under the effect of the thrust exerted on the wheel by the stabilizing means, furnishes the driving energy to the balance-wheel.

BRIEF DESCRIPTION OF THE DRAWING

The drawing shows, by way of example, two embodiments constructed in accordance with the invention.

DESCRIPTION OF THE PREFERRED EMBODIMENTS

Figure 1:
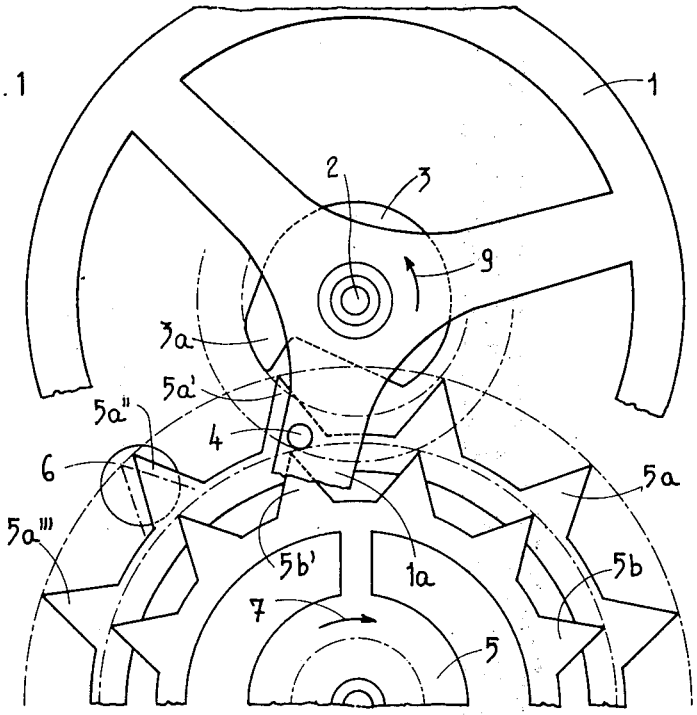
FIG. 1 is a plan view, from underneath, of a first embodiment of an escapement mechanism for a timepiece.
Figure 2:
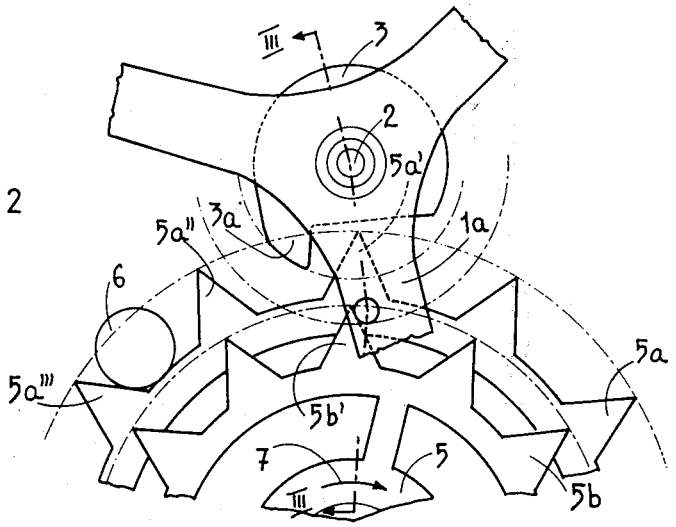
FIG. 2 is a plan view, from underneath, of the mechanism of FIG. 1, the same being shown in another working position.
Figure 3:
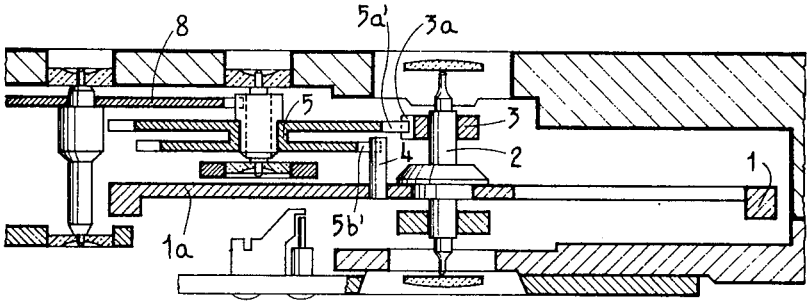
FIG. 3 is a sectional view taken along the line III—III of FIG. 2 in the direction indicated generally.

The mechanism represented in FIGS. 1 to 3 comprises a balance-wheel 1, the shaft 2 of which carries a plate 3 provided with a tooth 3*a*. One of the arms 1*a* of the balance-wheel 1 carries a pin 4. The balance-wheel 1 cooperates with an escapement wheel 5 provided with two toothings 5*a* and 5*b*, of different diameters. Wheel 5 may be constructed of any ferromagnetic material, such as soft iron. A stationary magnet 6, carried by the frame of the movement, cooperates with the tooth 5*a* of the escapement wheel 5 for ensuring the stability of the several rest positions of wheel 5.

The mechanism as disclosed operates as follows:

The wheel 5 is urged in rotation in the direction indicated by arrow 7 of FIGS. 1 and 2 by a driving mechanism, only a wheel 8 of which has been represented in FIG. 3. There results that, in its rest positions, wheel 5 occupies the position represented in solid lines in FIG. 1 while, if the wheel is not urged by the motor, the wheel is maintained by the magnet 6, at rest, in the position represented in lines.

When the balance-wheel 1 is displaced in the direction of the arrow 9, the tooth 3*a* of plate 3 comes in contact with one tooth, 5*a* of the toothing 5*a*, and displaces the wheel 5 in its normal direction of rotation, that is to say in the direction of the arrow 7, against the action of the return magnet 6.

When the tooth 5*a*'' of the toothing 5*a* initially submitted to the action of the magnet 6 escapes from the influence of the magnet, the next tooth 5*a*''' enters then in the zone of influence of the magnet 6 and is attracted by the magnet. At this time, one of the teeth 5*b*' of the toothing 5*b* runs against the pin 4 of the balance-wheel 1 and gives the balance wheel a pulse. The energy of the escapement wheel 5 thus simultaneously is derived from the driving mechanism and from the magnet 6. The result is that the energy necessary for separating each tooth of the toothing 5*a* from the influence of the magnet is at least partially provided when the next tooth is attracted by the magnet.

During the reverse movements of the balance-wheel 1, the wheel 5 is slightly moved in the reverse direction, under the effect of the tooth 3*a* of the plate 3 of the balance-wheel acting on the toothing 5*a* without being passed over the position in which the magent 6 would complete the displacement. Instead, the magnet brings the wheel 5 back into its initial position.

The escapement mechanism thus operates as a single-beat escapement, that is to say an escapement which gives a single pulse for each full oscillation of the balance-wheel, or for each forward and reverse movement of the balance-wheel.

The mechanism disclosed also can operate as a counting mechanism, that is to say a mechanism ensuring connection between the balance-wheel 1 and the first wheel of the gearing driving the indicators, in the case of a timepiece in which the balance-wheel is driving. For this purpose, the above disclosed mechanism requires only slight modification of the position of the magnet 6.

As a matter of fact, this magnet must occupy a position slightly different so that, at rest, the wheel 5 occupies the position represented in full lines in FIG. 1 in spite of the fact that it is not submitted to the force of a driving mechanism.

During the movements of the balance-wheel in the direction of the arrow 9, the tooth 3*a* of the plate 3 comes in contact with the tooth 5*a*' of the toothing 5*a* and displaces the wheel 5, the force of the magnet exerted on the tooth 5*a*''' being returned to the balance-wheel when the toothing 5*b*' rejoins the pin 4 of the balance-wheel.

In the opposite direction of the displacements of the balance-wheel, the wheel 5 is only slightly displaced and comes back into its initial position.

It is to be noted that, with the mechanism operating either as an escapement mechanism or as a counting mechanism, the magent 6 can be replaced by any stabilizing device such as, for instance, a jumping spring acting on one or the other of the toothings 5*a* and 5*b*.

Figure 4:
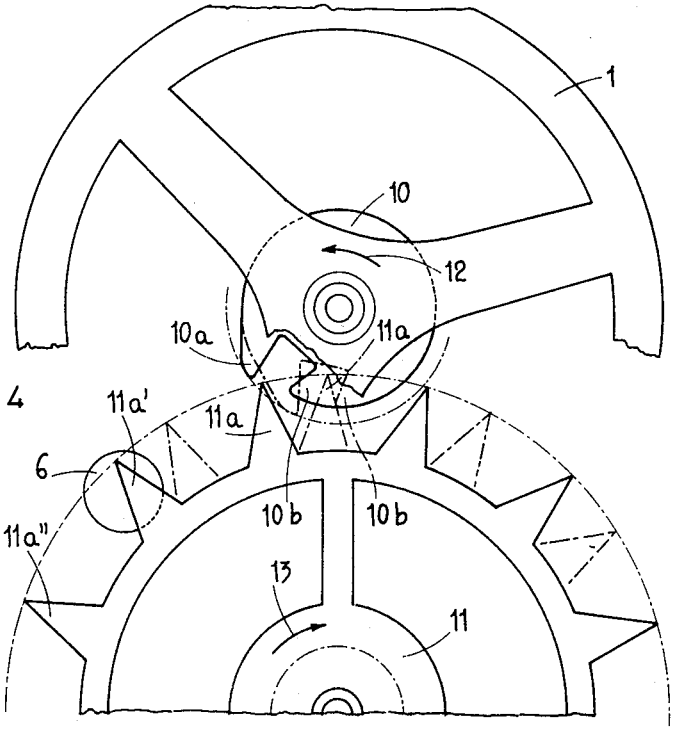
FIG. 4 is a plan view of a second embodiment of an escapement mechanism.

In the embodiment of FIG. 4, the balance-wheel 1 carries a plate 10 provided with two teeth 10*a* and 10*b*, of different lengths. The escapement wheel, 11, has only one toothing and is submitted to the action of a permanent magnet 6.

The operation of this embodiment is as follows:

When the balance-wheel rotates in the direction of the arrow 12, the tooth 10*a* of the plate 10 comes in contact with a tooth 11*a* of the escapement wheel and thus drives this escapement wheel in the direction of the arrow 13. When the tooth, 11*a*' initially submitted to the action of the magnet 6 escapes from the action of the magnet, the next tooth, 11*a*'' comes then under the influence of the magnet which attracts the tooth. As shown by the representation in dotted lines of the plate 10 and of the toothing of the escapement wheel, during the movement of this wheel under the effect of the magnet 6, the tooth 11*a* runs against the tooth 10*b* of the plate 10 and gives a driving pulse to the balance-wheel. The energy of the driving wheel is thus furnished at the same time by the driving mechanism, not shown, driving the escapement wheel 11, and by the magnet 6, as in the case of the first embodiment.

During the reverse movements of the balance-wheel in the opposite direction, the escapement wheel is only slightly displaced in the reverse direction and is brought back to its initial position by the magnet 6.

The mechanism of FIG. 4 also can operate as a counting mechanism, provided the magnet 6 is placed in such a way as to maintain the wheel 11 at rest in the position represented in solid lines in the drawing notwithstanding the fact that this wheel is not urged in rotation by a driving mechanism.

When the balance-wheel rotates in the direction of the arrow 12, the tooth 10*a* acts on the tooth 11*a*of the wheel 11 and moves wheel 11 in the direction of the arrow 13. During this movement, and when the tooth 11*a''* is attracted by the magnet 6, the tooth 11*a* rejoins the tooth 10*b* of the plate 10 and returns to the balance-wheel a part of the energy which has been necessary for pulling the tooth 11*a'* out from the influence of the magnet.

What I claim is:

1. A mechanism for operating a timepiece having a balance-wheel, said mechanism comprising, a toothed mechanism wheel movable between several rest positions, stabilizing means associated with the mechanism wheel and acting thereon for ensuring the stability of the several rest positions of the mechanism wheel, the balance-wheel carrying first and second abutting members adapted to cooperate successively with the teeth of said mechanism wheel, said first abutting member operable on one tooth of the mechanism wheel to cause the mechanism wheel to leave a first rest position against the action of said stabilizing means, and said tooth of the mechanism wheel being operable on said second abutting member under the effect of a thrust exerted on the mechanism wheel by said stabilizing means to provide driving energy to the balance-wheel.

2. A mechanism as claimed in claim 1 in which said stabilizing means include at least a stationary magnet acting on the teeth of the mechanism wheel.

3. A mechanism as claimed in claim 1 in which the abutting members are two teeth on a plate rigidly formed with the balance-wheel, each tooth being of a different length.

* * * * *